US009307791B2

(12) United States Patent
Garcia

(10) Patent No.: US 9,307,791 B2
(45) Date of Patent: Apr. 12, 2016

(54) SYSTEM AND METHODOLOGY FOR PROVIDING SHIRT COLLAR SUPPORT

(76) Inventor: Lawrence Garcia, Fresno, CA (US)

( * ) Notice: Subject to any disclaimer, the term of this patent is extended or adjusted under 35 U.S.C. 154(b) by 336 days.

(21) Appl. No.: 13/447,164

(22) Filed: Apr. 14, 2012

(65) Prior Publication Data

US 2013/0269078 A1 Oct. 17, 2013

(51) Int. Cl.
*D06C 15/00* (2006.01)
*A41B 1/14* (2006.01)
*D06F 59/02* (2006.01)

(52) U.S. Cl.
CPC .. *A41B 1/14* (2013.01); *D06F 59/02* (2013.01)

(58) Field of Classification Search
CPC ..... B65D 85/18; B65D 85/182; A41B 3/06; A41B 3/12; A41B 3/18; A41B 1/14; D06F 59/02; A47G 25/20
See application file for complete search history.

(56) References Cited

U.S. PATENT DOCUMENTS 443,023 A * 12/1890 Weir ..... 2/132
714,461 A * 11/1902 Dieter ..... 2/134
892,604 A * 7/1908 Meehan ..... 2/132
1,820,287 A * 8/1931 Morck ..... 223/83
2,304,464 A * 12/1942 Manaster ..... 2/132
2,438,325 A * 3/1948 Pophal ..... 2/132
2,551,879 A * 5/1951 Freedman ..... 223/83
2,610,774 A * 9/1952 Calder ..... 223/83
2,719,657 A * 10/1955 Allen et al. ..... 223/84
2,823,839 A * 2/1958 Bunch ..... 223/83
2,864,540 A * 12/1958 Kass ..... 223/83
2,880,928 A * 4/1959 Merrill ..... 223/98
3,233,799 A * 2/1966 Abbey ..... 223/83
3,318,498 A * 5/1967 Younglove ..... 223/83
3,738,548 A * 6/1973 Lojinger ..... 223/83
4,133,463 A * 1/1979 Bourrian ..... 223/83
4,669,642 A * 6/1987 Nicholas ..... 223/94
8,296,865 B2 * 10/2012 Garcia ..... 2/132

FOREIGN PATENT DOCUMENTS

GB 969758 A * 9/1964 ..... B65D 85/182

* cited by examiner

*Primary Examiner* — Nathan Durham
(74) *Attorney, Agent, or Firm* — Daniel S. Castro; Loza & Loza, LLP

(57) ABSTRACT

Aspects for supporting a turndown shirt collar are disclosed. In a particular aspect, a semi-rigid shapeable device includes a rear region that forms a substantially semi-circle shape having a first and second end. For this particular embodiment, each of a first terminal end and a second terminal end are respectively oriented upwards and inwards relative to the rear region via a first bend at the first end and a second bend at the second end. In another aspect, a method that facilitates forming a shirt collar support is provided, which includes shaping a semi-rigid shapeable device into a substantially semi-circle shape. In a further aspect, a turndown collared shirt is provided, which includes a collar band comprising at least one collar sleeve configured to hold a shaping device.

10 Claims, 12 Drawing Sheets

100

200

300

SYSTEM AND METHODOLOGY FOR PROVIDING SHIRT COLLAR SUPPORT

TECHNICAL FIELD

The subject disclosure generally relates to turndown collared shirts, and more specifically to a system and methodology for providing shirt collar support.

BACKGROUND

By way of background concerning conventional turndown collared shirts, it is noted that such shirts often undesirably lose collar support. For instance, a turndown collared shirt that remains on a store shelf may quickly lose collar support over time. Indeed, in order to mitigate a loss of such support, manufacturers often package their shirts together with a plastic/cardboard insert wrapped around the collar band. This solution, however, is limited to preserving collar support prior to purchase since such inserts are not wearable. Moreover, since these inserts are not wearable, they are often discarded soon after a shirt is purchased. As a result, these shirts quickly lose collar support over time and after repeated use.

To regain collar support after use, shirts may be pressed by professional dry cleaners. Such solution can be expensive though, and the stiffness of a recently pressed collar can quickly wear off during use. For example, even a recently pressed shirt collar may undesirably lose its shape and lay flat towards the end of a work day because of normal everyday movement, and as perspiration accumulates.

Accordingly, it would be desirable to provide a device and methodology which overcomes these limitations. To this end, it should be noted that the above-described deficiencies are merely intended to provide an overview of some problems of conventional systems, and are not intended to be exhaustive. Other problems with the state of the art and corresponding benefits of some of the various non-limiting embodiments may become further apparent upon review of the following detailed description.

SUMMARY

A simplified summary is provided herein to help enable a basic or general understanding of various aspects of exemplary, non-limiting embodiments that follow in the more detailed description and the accompanying drawings. This summary is not intended, however, as an extensive or exhaustive overview. Instead, the sole purpose of this summary is to present some concepts related to some exemplary non-limiting embodiments in a simplified form as a prelude to the more detailed description of the various embodiments that follow.

In accordance with one or more embodiments and corresponding disclosure, various non-limiting aspects are described in connection with supporting a turndown shirt collar. In one such aspect, a semi-rigid shapeable device is disclosed, which includes a rear region configured to form a substantially semi-circle shape having a first end and a second end. The semi-rigid shapeable device also comprises an ends region, which includes a first portion extending from the first end to a first terminal end, and a second portion extending from the second end to a second terminal end. For this particular embodiment, the first portion forms a first bend at the first end to orient the first terminal end upwards and inwards relative to the rear region, whereas the second portion forms a second bend at the second end to orient the second terminal end upwards and inwards relative to the rear region.

In another aspect, a method that facilitates forming a shirt collar support is provided. The method includes shaping a semi-rigid shapeable device into a substantially semi-circular shape having a first terminal end and a second terminal end. The method further includes bending opposite ends of the semi-rigid shapeable device to form a first bend proximate to the first terminal end, and a second bend proximate to the second terminal end. For this embodiment, the first bend is configured to orient the first terminal end upwards and inwards relative to a rear region of the semi-rigid shapeable device, whereas the second bend is configured to orient the second terminal end upwards and inwards relative to the rear region of the semi-rigid shapeable device.

In a further aspect, a turndown collared shirt is provided, which includes a collar band attached to a folded collar. Within such embodiment, the collar band includes at least one collar sleeve configured to hold a shaping device, whereas the folded collar includes a first collar point and a second collar point such that a spread length between the first collar point and the second collar point varies according to a presence of the shaping device within the at least one collar sleeve.

Other embodiments and various non-limiting examples, scenarios and implementations are described in more detail below.

BRIEF DESCRIPTION OF THE DRAWINGS

Various non-limiting embodiments are further described with reference to the accompanying drawings in which.

DETAILED DESCRIPTION

As discussed in the background, turndown collared shirts often undesirably lose collar support. The various embodiments disclosed herein are directed towards overcoming these limitations via discrete and continuous collar support. For instance, embodiments directed towards a wearable shirt collar shaping device are disclosed, as well as embodiments encompassing methodologies to facilitate forming such devices. Embodiments directed towards a turndown collared shirt configured to be coupled with a shaping device are also disclosed.

Figure 1:
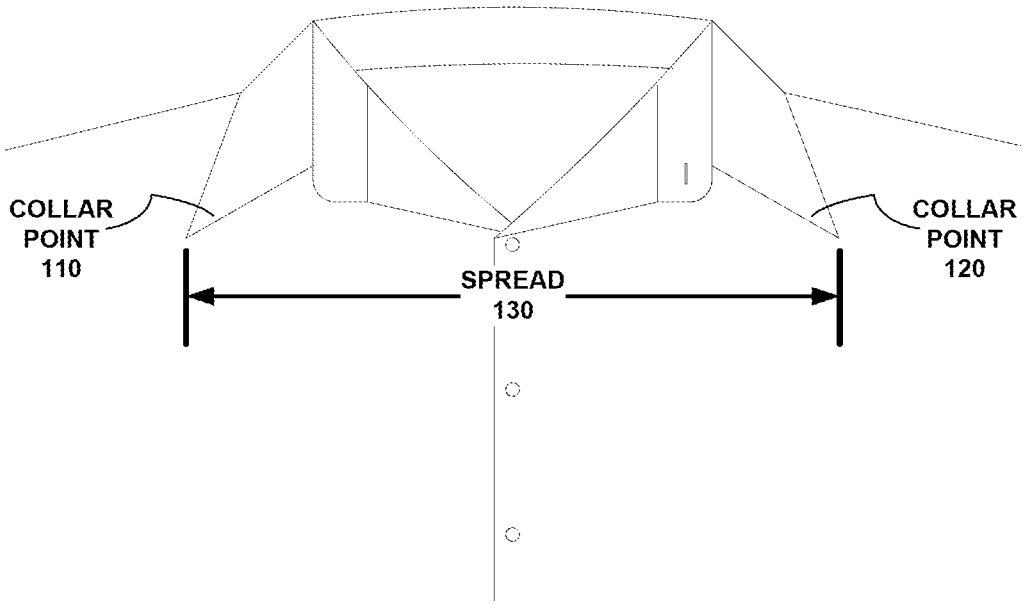
FIG. 1 Prior Art
FIG. 1 illustrates an exemplary turndown collared shirt without a collar support apparatus.

Turning now to FIG. 1, an exemplary turndown collared shirt without a collar support apparatus is shown. As illustrated, turndown collared shirt 100 includes collar point 110 and collar point 120, wherein spread 130 is defined as the distance between collar point 110 and collar point 120. To this end, it should be noted that spread 130 undesirably increases as turndown collared shirt 100 loses collar support. Moreover, as turndown collared shirt 100 loses collar support, each of collar point 110 and collar point 120 undesirably lay more flat.

Figure 2:
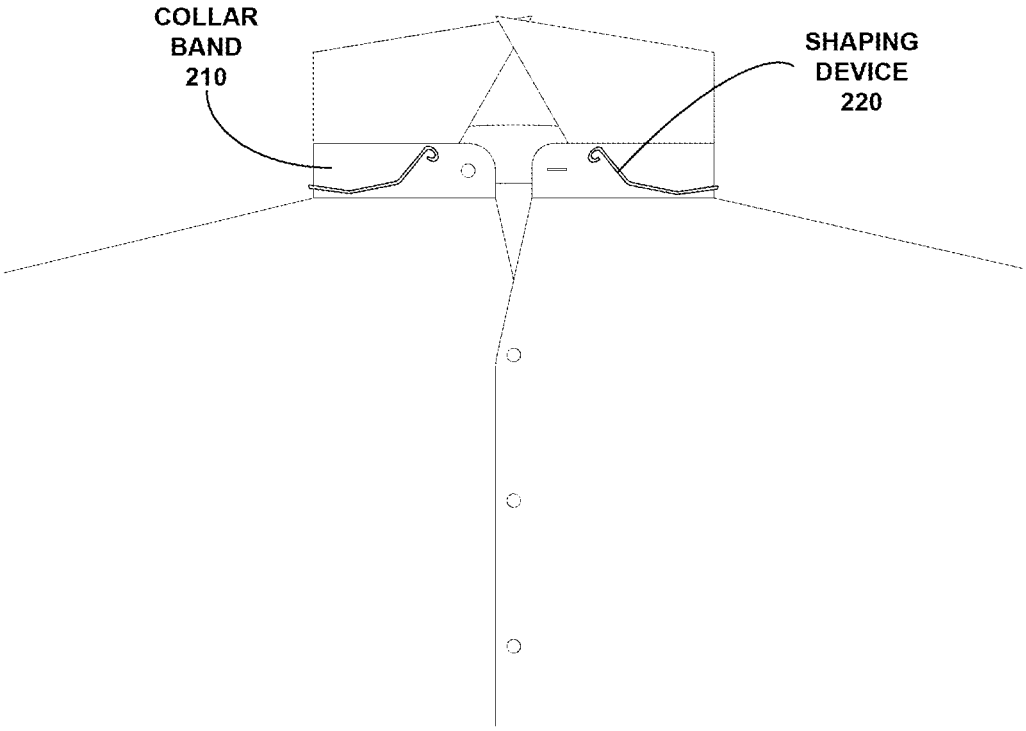
FIG. 2 illustrates an exemplary a shaping device coupled to a turndown collared shirt in accordance with an aspect of the subject specification.
Figure 3:
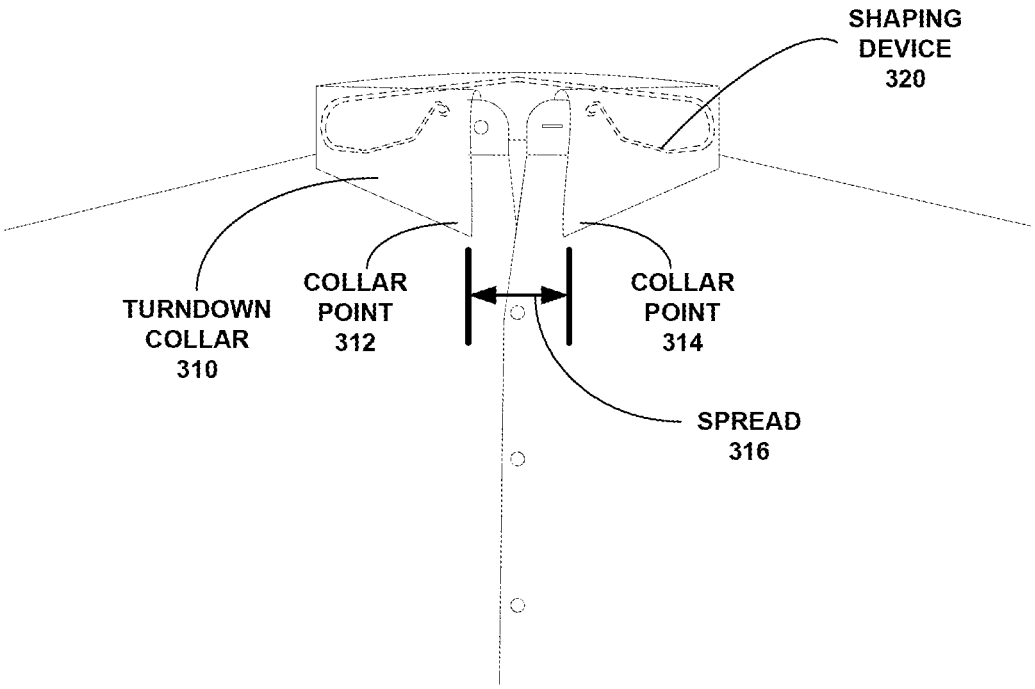
FIG. 3 illustrates an exemplary support provided by a shaping device on a turndown collared shirt according to an embodiment.

To overcome this limitation, a wearable shaping device is contemplated. In FIG. 2, an exemplary configuration of such shaping device is shown coupled to a turndown collared shirt in accordance with an embodiment. As illustrated, shaping device 220 is configured to wrap around collar band 210 of turndown collared shirt 200. Once wrapped around collar band 210, shaping device 220 provides discrete and continuous collar support to turndown collared shirt 200. In FIG. 3, an exemplary illustration of such support is provided. As illustrated, shaping device 320 discretely tucks beneath turndown collar 310 of turndown collared shirt 300 such that shaping device 320 is unnoticeable during use. Indeed, in an aspect, shaping device 320 is thus a wearable apparatus configured to continuously provide an "invisible" collar support, which prevents collar point 312 and collar point 314 from spreading beyond spread 316. In comparison, it is noted that spread 316 maintained by shaping device 320 is desirably shorter than spread 130 illustrated in FIG. 1, which does not include such shaping device.

Figure 4:
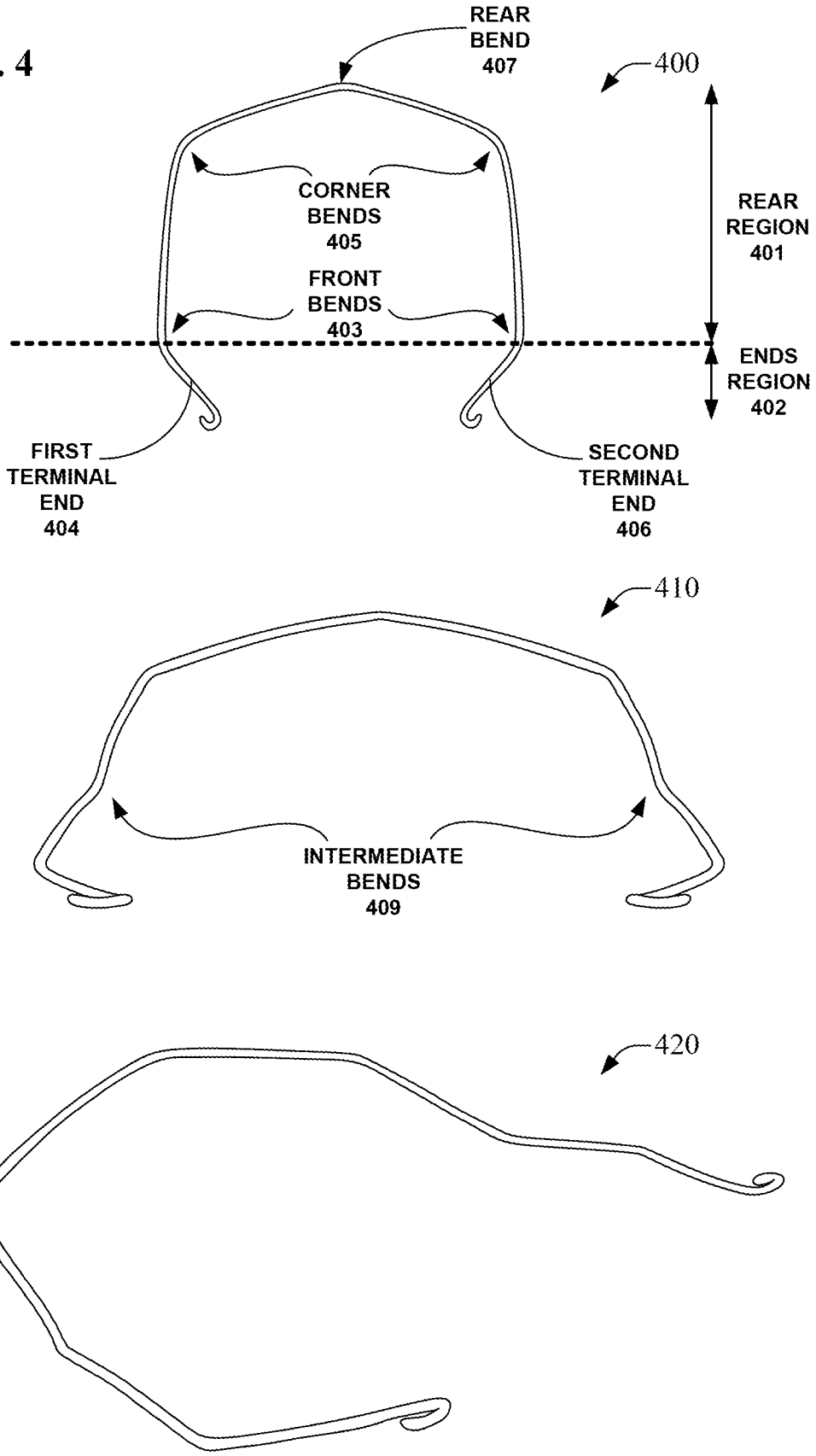
FIG. 4 illustrates various views of an exemplary collar support apparatus in accordance with an aspect of the subject specification.

Referring next to FIG. 4, various views 400, 410, and 420, of an exemplary collar support apparatus are provided. Here, it should be appreciated that contemplated embodiments include, but are not limited to, a semi-rigid shapeable device configured to firmly maintain its shape. In a first view 400, such apparatus is shown to include rear region 401 and ends region 402, wherein rear region 401 is configured to form a substantially semi-circle shape having a first end and a second end, and wherein ends region 401 includes a first portion extending from the first end to first terminal end 404, and a second portion extending from the second end to second terminal end 406. For this particular embodiment, the first portion of ends region 401 forms a first one of front bends 403 at the first end to orient first terminal end 404 upwards and inwards relative to rear region 401, whereas the second portion of ends region 401 forms a second one of front bends 403 at the second end to orient second terminal end 406 upwards and inwards relative to rear region 401.

In another aspect, it should be noted that rear region 401 may be configured to include a squared edge opposite to an open region of the substantially semi-circle shape. Such a squared edge may be included to facilitate shaping the rear portion of a turndown collar to appear newly pressed while worn. Rear bend 407 may also be included so as to provide comfort near the back of a user's neck. Within such embodiment, rear bend 407 is included at a midpoint of the squared edge, and configured to orient the midpoint upwards relative to opposite halves of the squared edge.

Additional bends are also contemplated. For instance, intermediate bends 409 may be included to raise first terminal end 404 and second terminal end 406 so as to facilitate tucking them more discreetly beneath a turndown collar. For this particular embodiment, rear region 401 includes a first side portion extending between the squared edge and the first end, wherein the first side portion includes a first one of intermediate bends 409 at a first intermediate point, and wherein the first one of intermediate bends 409 is configured to orient the first intermediate point downwards relative to opposite sides of the first side portion. Similarly, on the opposite side, rear region 401 includes a second side portion extending between the squared edge and the second end, wherein the second side portion includes a second one of intermediate bends 409 at a second intermediate point, and wherein the second one of intermediate bends 409 is configured to orient the second intermediate point downwards relative to opposite sides of the second side portion.

In another aspect, it is noted that it may be desirable to prevent the shaping device from slipping while in use. Accordingly, it is contemplated that a portion of at least one of rear region 401 or ends region 402 further comprises a non-slip coating. Since it is anticipated that the disclosed shaping device will be used with conventional turndown collar shirts, such non-slip coating can be any of a plurality of materials that when in contact with the collar band of a turndown collar shirt creates a coefficient of friction above a slippage threshold (e.g., rubber, velvet, etc).

Figure 5:
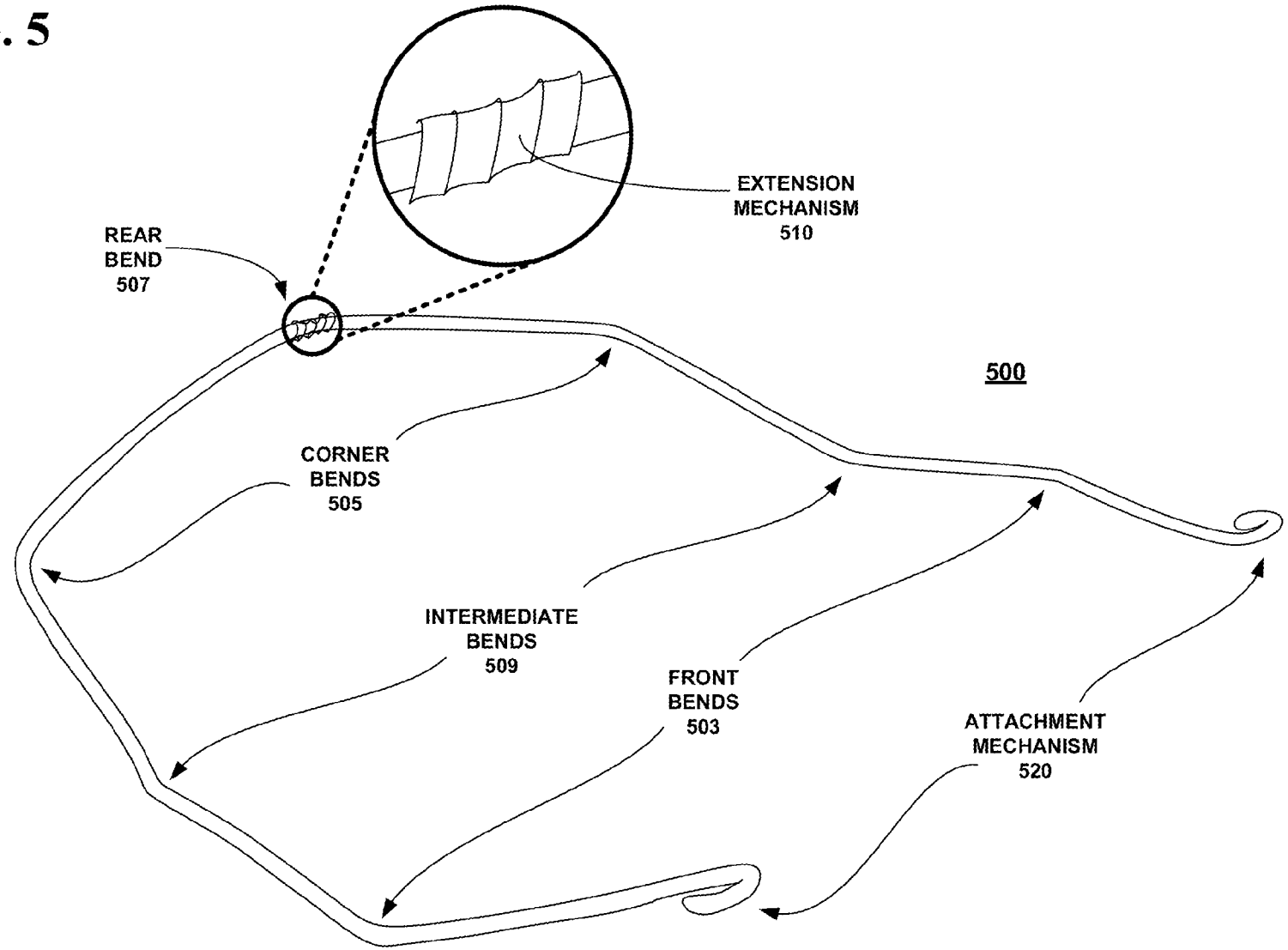
FIG. 5 illustrates an extendable collar support apparatus according to an embodiment.

Other desirable features may also be included. For instance, in order to accommodate collars of different sizes, it may be desirable to include at least one extension point configured to elongate at least one of rear region 401 or ends region 402. In FIG. 5, an exemplary extendable collar support apparatus with such extension point is provided. As illustrated, shaping device 500 may include extension mechanism 510 proximate to rear bend 507. For this particular example, although an accordion-like mechanism is shown, it should be appreciated that extension mechanism 510 can be any of a plurality of mechanisms known in the art. Furthermore, although FIG. 5 shows extension mechanism 510 inserted into rear bend 507, it should be appreciated that extension mechanism 510 may be inserted into any of front bends 503, corner bends 505, intermediate bends 509, and/or rear bend 507. Alternatively, or in addition to, it is contemplated that extension points may be included in non-bend points, as well.

Figure 7:
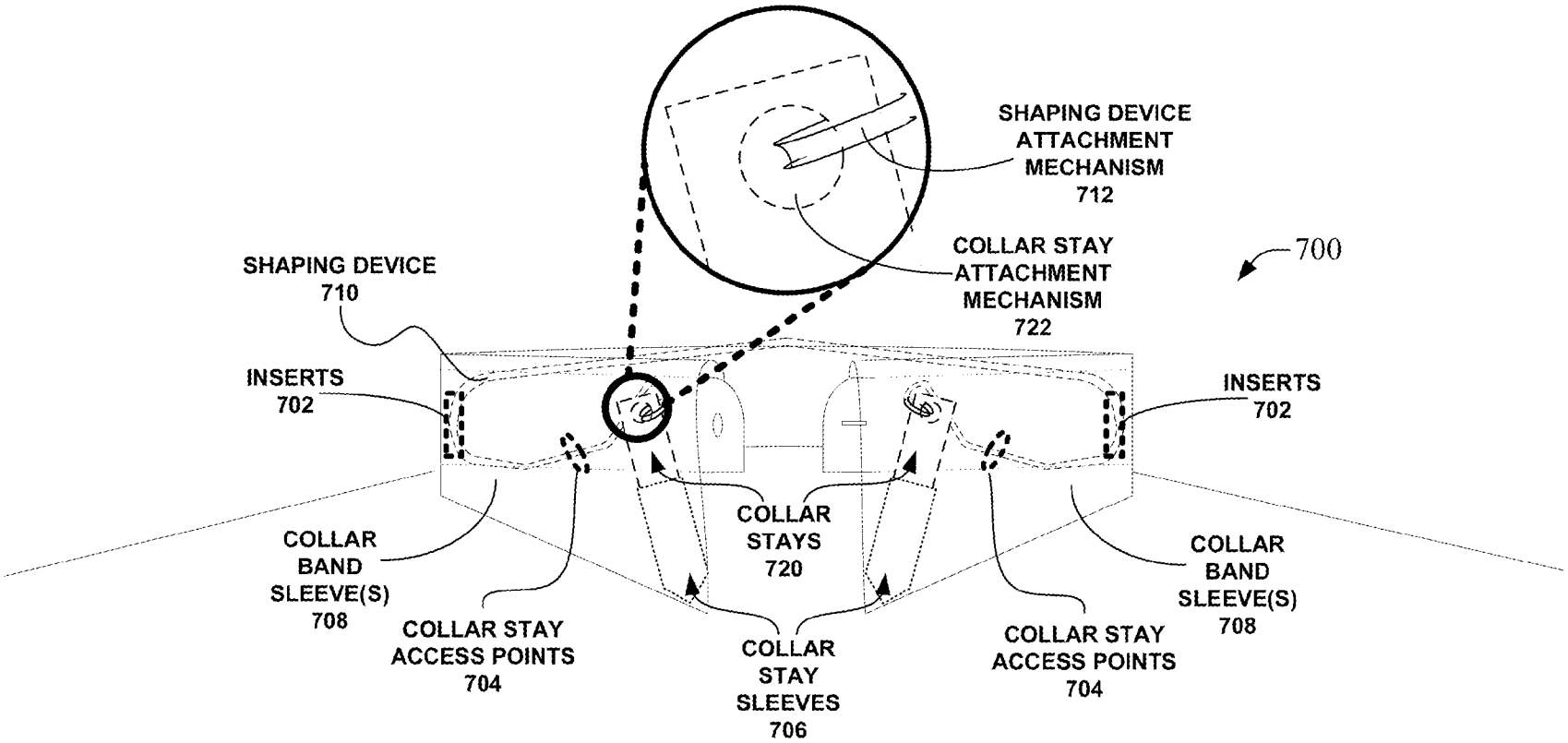
FIG. 7 illustrates an exemplary turndown collared shirt according to another embodiment.

In another aspect, it is contemplated that including an attachment mechanism to ends of the disclosed shaping device may also be desirable. For instance, as illustrated in FIG. 5, a first terminal end of shaping device 500 may include a first end of attachment mechanism 520, whereas a second terminal end of shaping device 500 may include a second end of attachment mechanism 520. In a first exemplary embodiment of attachment mechanism 520, each of the first end of attachment mechanism 520 and the second end of attachment mechanism 520 are configured to be attachable to one another (e.g., to facilitate having shaping device 500 maintain/regain its shape). In another exemplary embodiment, however, each of the first end of attachment mechanism 520 and the second end of attachment mechanism 520 are configured to be attachable to a collar stay (e.g., as illustrated in FIG. 7). Furthermore, although attachment mechanism 520 is shown to be a hook mechanism, it should be appreciated that any of a plurality of mechanisms can be implemented including, for example, a magnetic mechanism.

Figure 6:
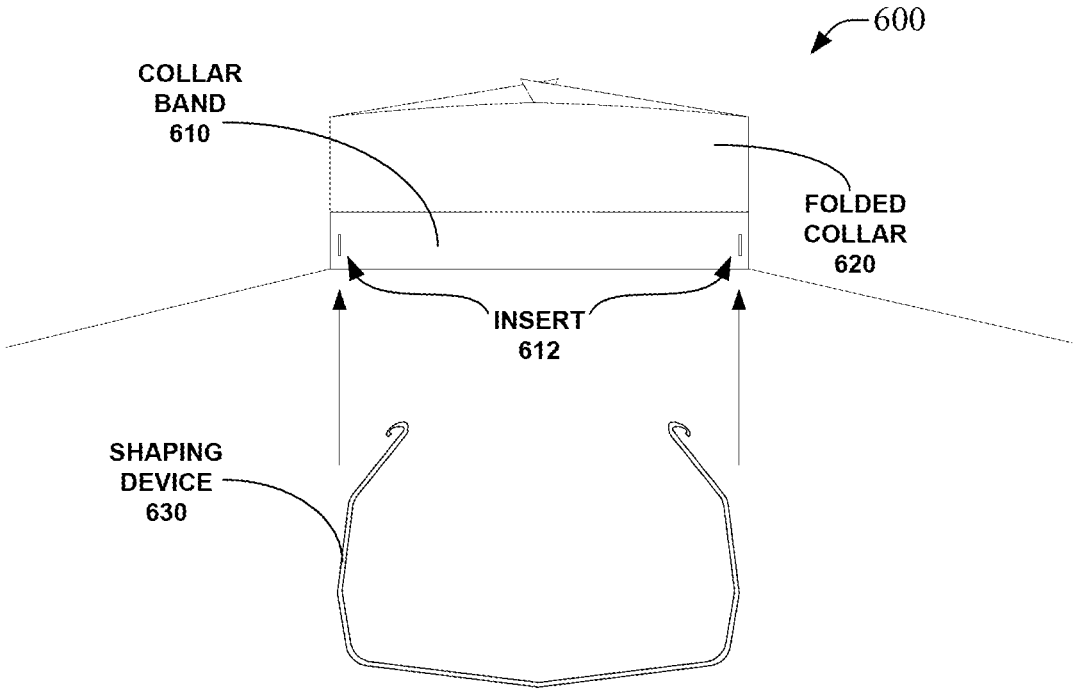
FIG. 6 illustrates an exemplary turndown collared shirt according to an embodiment.
Figure 6:
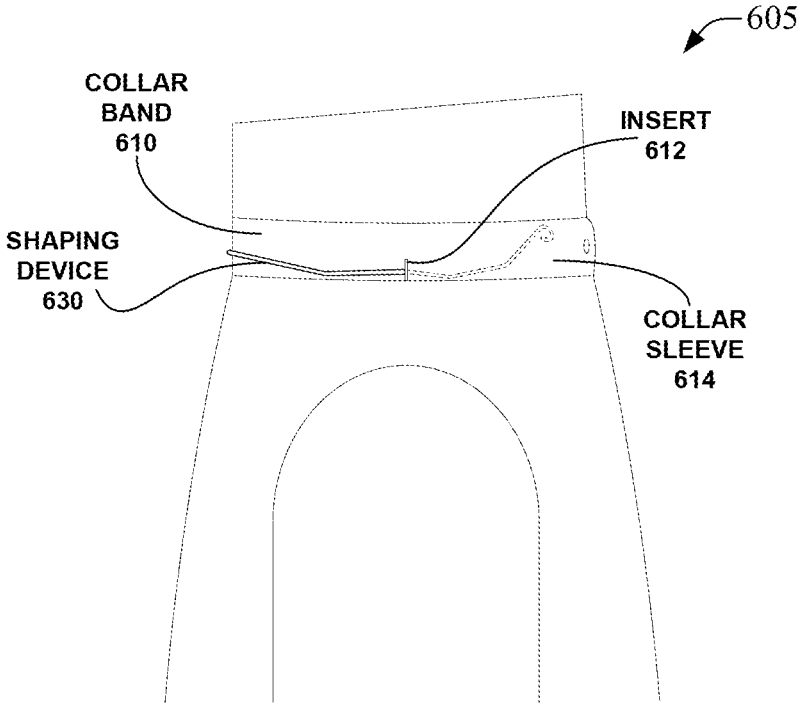

Embodiments directed towards a turndown collared shirt configured to be used in conjunction with the disclosed shaping device are also contemplated. In FIG. 6, for instance, views 600 and 605 of an exemplary turndown collared shirt are provided according to an embodiment. As illustrated, a turndown collared shirt is provided, which includes collar band 610 attached to folded collar 620. Within such embodiment, collar band 610 includes at least one collar sleeve 614 configured to hold shaping device 630, as shown. In an aspect, collar sleeve 614 is thus a compartment within collar band 610 that facilitates guiding shaping device 630 into place. Furthermore, it is noted that folded collar 620 includes a first collar point and a second collar point such that a spread length between the first collar point and the second collar point varies according to a presence of shaping device 630 within collar sleeve 614.

It should be appreciated that collar band 610 may be configured to hold shaping device 630 in various ways. For instance, in a first embodiment, collar band 610 includes insert 612, wherein a first insert point is configured to receive a first end of shaping device 630 at a first one of collar sleeve 614, and wherein collar band 610 further includes a second insert point configured to receive a second end of shaping device 630 at a second one of collar sleeve 614. Within such embodiment, collar sleeve 614 thus includes two sleeves on opposite ends of collar band 610 so as to facilitate receiving and removing shaping device 630 via insert 612, as shown. In another embodiment, however, rather than including insert 612, shaping device 630 is entirely enclosed within a single collar sleeve 614.

Furthermore, as stated previously, it may be desirable to prevent shaping device 630 from slipping while in use. Accordingly, it is contemplated that an inner portion of collar sleeve 614 may comprise a non-slip lining. Such non-slip lining can be any of a plurality of materials that when in contact with shaping device 630 creates a coefficient of friction above a slippage threshold (e.g., rubber, velvet, etc).

As also stated previously, it may be desirable to have shaping device 630 attach to collar stays. Accordingly, embodiments configured to facilitate such attachment are disclosed, such as the exemplary turndown collared shirt provided in FIG. 7. As illustrated, turndown collared shirt 700 may be configured to receive shaping device 710 via inserts 702. Alternatively, rather than including inserts 702, turndown collared shirt 700 may be configured to include shaping device 710 within a single collar sleeve, as mentioned previously. Within either embodiment, turndown collared shirt 700 may further include collar stay sleeves 706, as shown, wherein a first one of collar stay sleeves 706 is proximate to a first collar point, and wherein a second one of collar stay sleeves 706 is proximate to a second collar point. To facilitate providing shaping device 710 access to collar stays 720, a first one/end of collar band sleeve(s) 708 includes a first one of collar stay access points 704 configured to provide access to a first area proximate to a first one of collar stay sleeves 706, whereas a second one/end of collar band sleeve(s) 708 includes a second one of collar stay access points 704 configured to provide access to a second area proximate to a second one of collar stay sleeves 706.

It should be appreciated that any of a plurality of attachment mechanisms are contemplated for attaching shaping device 710 to collar stays 720. For instance, as illustrated, a hook mechanism may be implemented, wherein shaping device 710 includes shaping device attachment mechanism 712, which is configured to hook onto collar stay attachment mechanism 722. Alternatively, rather than implementing a hook mechanism, a magnetic mechanism can be used, wherein either ends of shaping device attachment mechanism 712 are configured to have a first magnetic polarity, and wherein components of collar stay attachment mechanism 722 are configured to have an opposite magnetic polarity.

Figure 8:
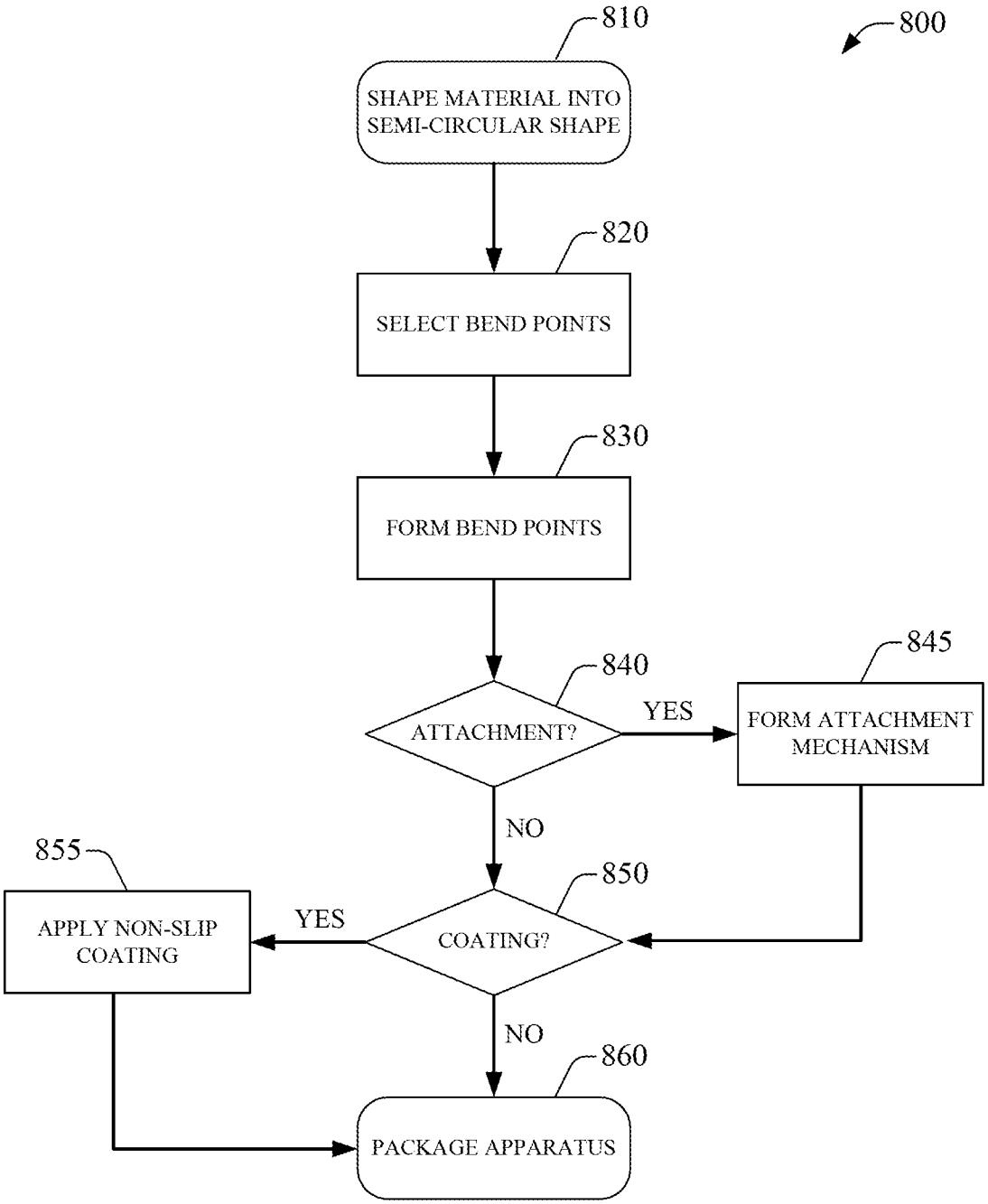
FIG. 8 is a flow diagram of an exemplary methodology that facilitates forming a shirt collar shaping device in accordance with an aspect of the subject specification.

Referring next to FIG. 8, a flow chart illustrating an exemplary method that facilitates forming a shirt collar shaping device is provided. As illustrated, process 800 includes a series of acts that may be performed within a computer system according to an aspect of the subject specification. For instance, process 800 may be implemented by employing a processor to execute computer executable instructions stored on a computer readable storage medium to implement the series of acts. In another embodiment, a computer-readable storage medium comprising code for causing at least one computer to implement the acts of process 800 is contemplated.

In an aspect, process 800 begins with the shaping of a wire-shaped material at act 810. Here, as stated previously, it is contemplated that such material may be any of a plurality of material types which may be bent and/or formed into a semi-circular shape substantially similar to collar support apparatus 400. For instance, in one embodiment, a steel wire material may be bent into a substantially semi-circular shape. In another embodiment, however, it is contemplated that a plastic material is molded into a substantially semi-circular shape.

It should be noted that, because any of various collar support preferences may be desired, it is contemplated that the shaping performed at act 810 may vary accordingly. For instance, in a particular embodiment, the shaping at act 810 comprises forming a rear region that includes a squared edge opposite to an open region of the substantially semi-circular shape. Alternatively, rather than a squared edge, the shaping at act 810 may comprise forming a rear region with a rounded edge.

After the shaping performed at act 810, process 800 continues to act 820 where bend points for the shirt collar shaping device are selected. To this end, it is noted that any of a plurality of bend types may be selected including, for example, any of front bends 403, corner bends 405, intermediate bends 409, and/or rear bend 407 illustrated in FIG. 4.

Once the bend types are selected, process 800 proceeds to act 830 where the selected bend types are formed. In one embodiment, for example, a pair of front bends is formed by bending opposite ends of the wire-shaped apparatus. Within such embodiment, the first front bend is configured to orient a first end upwards and inwards relative to a rear region of the wire-shaped apparatus, whereas the second front bend is configured to orient the second end upwards and inwards relative to the rear region. Thereafter, the bending may further comprise forming at least one additional bend.

Since any of various materials may be used, it should be appreciated that the forming performed at act 830 may encompass any of a plurality of forming acts. For instance, if steel material is used, such forming may comprise bending the wire-shaped apparatus. However, if plastic material is used, bends may be formed by selecting a mold having the desired bends.

In another aspect, the forming performed at act 830 may further comprise including at least one extension mechanism. For instance, such extension mechanism may be an accordion-like mechanism such as extension mechanism 510 illustrated in FIG. 5. Within such embodiment, the forming performed at act 830 may include partitioning the wire-shaped apparatus at a desired extension point, and inserting an extension mechanism therein. To this end, although FIG. 5 shows extension mechanism 510 inserted into rear bend 507, it should be appreciated that an extension mechanism may be inserted into any of front bends 503, corner bends 505, intermediate bends 509, and/or rear bend 507. Alternatively, or in addition to, it is contemplated that extension points may be included in non-bend points, as well.

After the forming performed at act 830, process 800 proceeds to act 840 where a determination of whether to include an attachment mechanism, such as attachment mechanism 520 illustrated in FIG. 5, is made. In an aspect, such attachment mechanism may be configured to serve any of a plurality of purposes. For instance, the attachment mechanism may be configured to attach/detach opposing ends of the shirt collar shaping device, and/or to attach/detach to collar stays (e.g., as illustrated in FIG. 7). Here, in addition to the hook design illustrated in FIG. 5 and FIG. 7, it should be appreciated that other attachment mechanism designs can be implemented including, for example, a magnetic attachment mechanism.

If it is determined that an attachment mechanism should indeed be included, the desired attachment mechanism is formed at act 845, followed by a determination of whether to coat the shirt collar shaping device with a non-slip substance at act 850. Otherwise, if an attachment mechanism is not desired, process 800 proceeds directly to act 850. If a coating is desired, the shirt collar shaping device is coated at act 855, followed by a packaging of the shirt collar shaping device at act 860. Otherwise, if a coating is not desired, process 800 proceeds directly to act 860. Here, it should be noted that the packaging performed at act 860 may include packaging the shirt collar shaping device in any of various ways. For instance, the shaping device can be packaged by itself, together with a turndown collared shirt, and/or together with collar stays.

Figure 9:
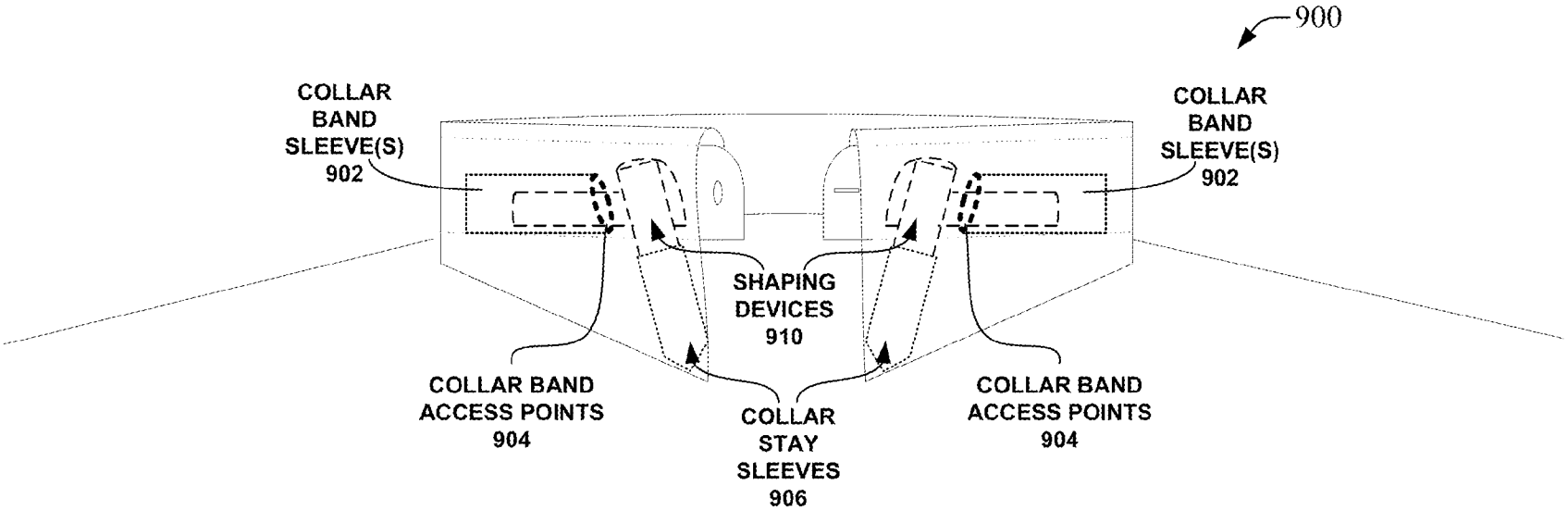
FIG. 9 illustrates an exemplary implementation of a dual shaping device embodiment inserted into a turndown collar shirt.

In another aspect, rather than having a single shaping device wrap around the rear of a user's neck, a dual device embodiment is also contemplated. In FIG. 9, an exemplary implementation of such dual device embodiment is provided. For this particular embodiment, shaping devices 910 respectively include a first end configured to be inserted into collar band sleeve(s) 902 via collar band access points 904, and a second end configured to be inserted into collar stay sleeves 906. Here, it is contemplated that each of shaping devices 910 are semi-rigid devices configured to keep their form over time similar to the aforementioned semi-circular devices. During use, shaping devices 910 thus separately provide collar support to each collar point of turndown collar shirt 900.

It should be noted that alternative embodiments are also contemplated in which shaping devices 910 are configured to attach to the single shaping device design described herein (e.g., via attachment mechanism 520 of shaping device 500). In yet another embodiment, rather than implementing an attach/detach design, a modified single shaping device design is contemplated in which the ends of the aforementioned single shaping device design are extended/modified to be substantially similar to shaping devices 910.

Figure 10:
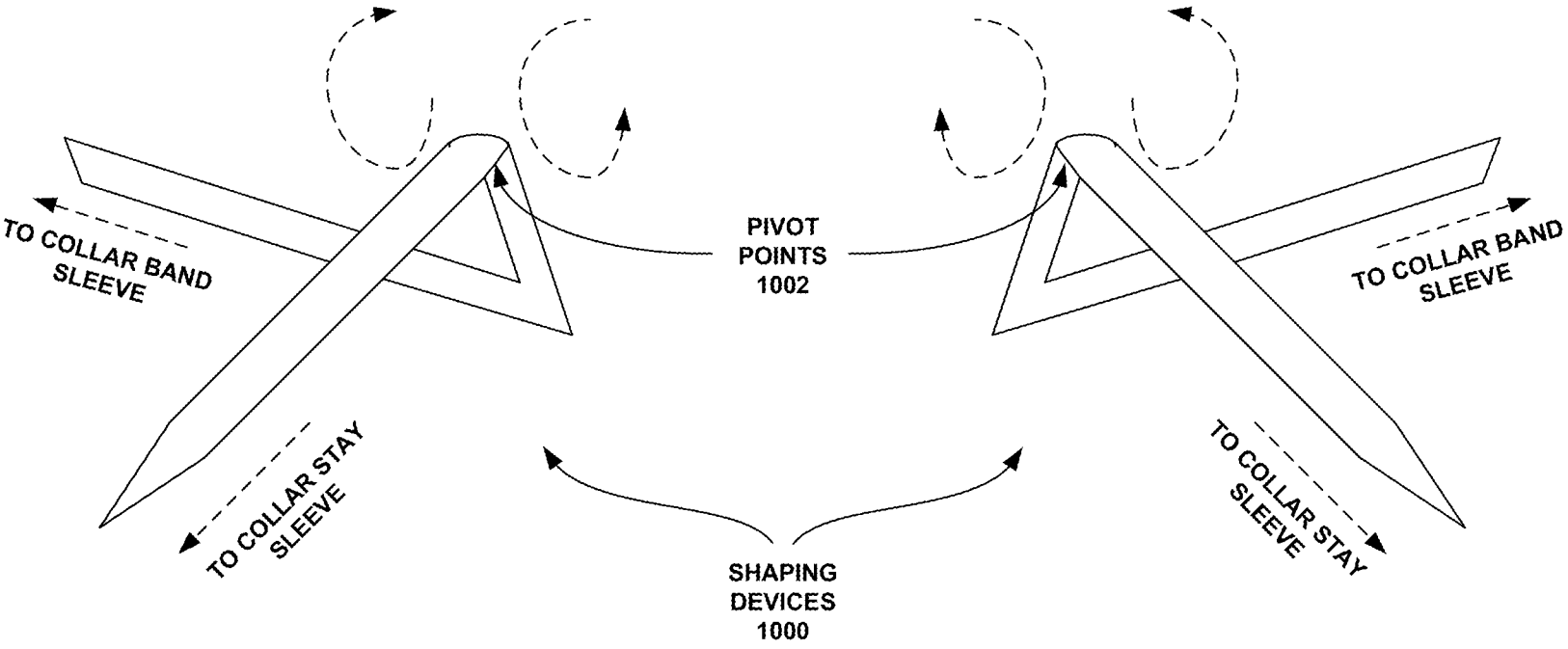
FIG. 10 illustrates exemplary pivot points of a dual shaping device embodiment.

Referring next to FIG. 10, a perspective view of an exemplary dual shaping device embodiment is provided. As illustrated, similar to shaping devices 910, shaping devices 1000 respectively include a first end configured to be inserted into a collar band sleeve, and a second end configured to be inserted into a collar stay sleeve. In a particular aspect, since it is contemplated that shaping devices 1000 are made of malleable semi-rigid material, pivot points 1002 may be included to facilitate pivoting the respective ends of shaping devices 1000, as desired. When inserting shaping devices 1000, for example, a user may begin by inserting a first end into a collar band sleeve, and then vertically extending the other end to facilitate inserting this other end into a collar stay sleeve. Indeed, once a first end of shaping device 1000 is inserted into a collar band sleeve, inserting the other end into the corresponding collar stay sleeve may be easier if the turndown collar is turned up. A user may then bend pivot point 1002 upwards so that the collar stay sleeve end extends vertically, which facilitates inserting this end into the collar stay sleeve while the turndown collar is turned up. Once both ends of shaping device 1000 are inserted, the user may then bend pivot point 1002 in the opposite direction so that turndown collar is turned back down. Here, since it is contemplated that shaping device 1000 can be made of any malleable material configured to keep its form over time, it should be noted that pivot point 1002 can be configured to facilitate raising/lowering turndown collars into fixed positions, as desired.

Exemplary Networked and Distributed Environments

One of ordinary skill in the art can appreciate that various embodiments for implementing the use of a computing device and related embodiments described herein can be implemented in connection with any computer or other client or server device, which can be deployed as part of a computer network or in a distributed computing environment, and can be connected to any kind of data store. Moreover, one of ordinary skill in the art will appreciate that such embodiments can be implemented in any computer system or environment having any number of memory or storage units, and any number of applications and processes occurring across any number of storage units. This includes, but is not limited to, an environment with server computers and client computers deployed in a network environment or a distributed computing environment, having remote or local storage.

Figure 11:
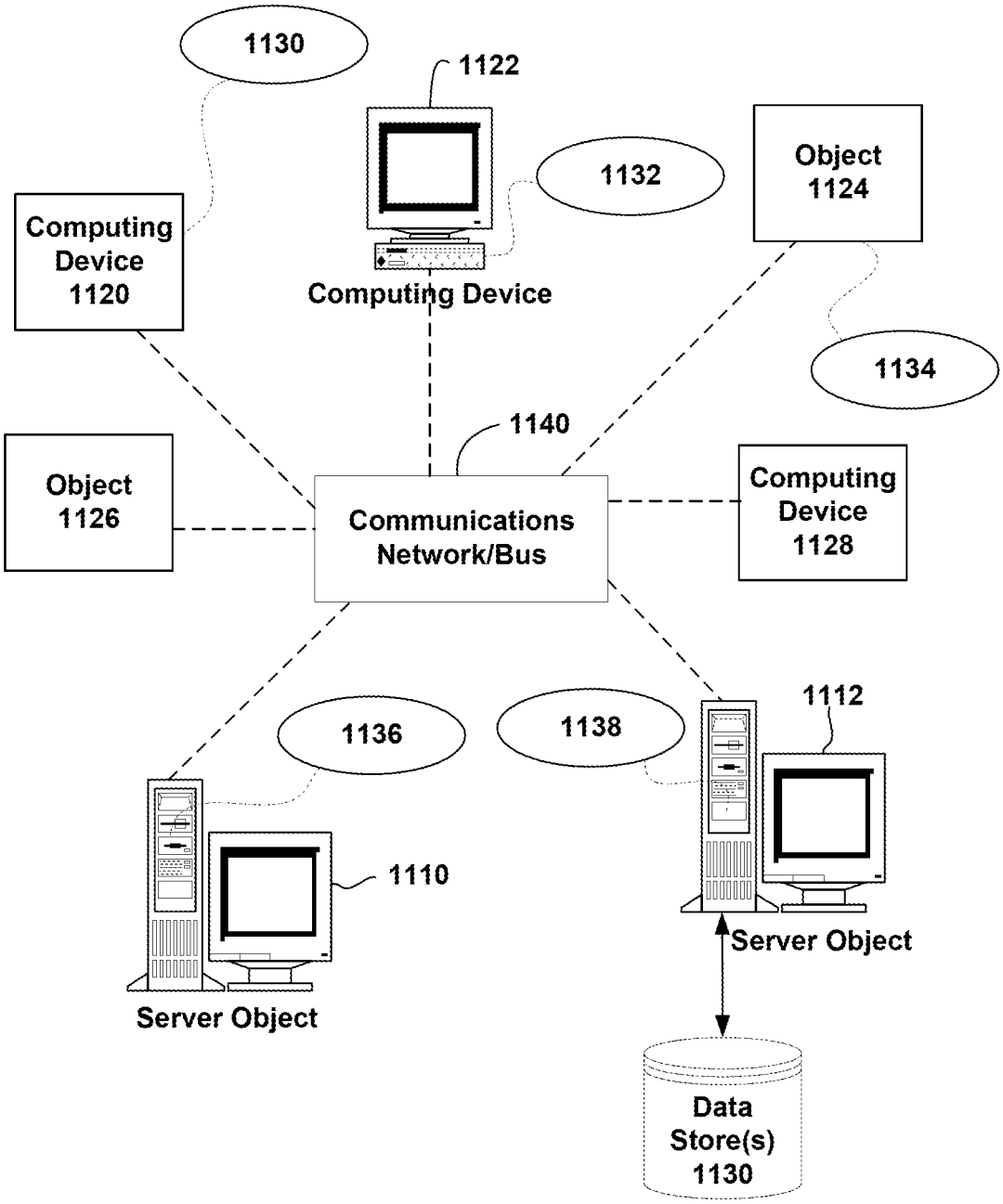
FIG. 11 is a block diagram representing exemplary non-limiting networked environments in which various embodiments described herein can be implemented.

FIG. 11 provides a non-limiting schematic diagram of an exemplary networked or distributed computing environment. The distributed computing environment comprises computing objects or devices 1110, 1112, etc. and computing objects or devices 1120, 1122, 1124, 1126, 1128, etc., which may include programs, methods, data stores, programmable logic, etc., as represented by applications 1130, 1132, 1134, 1136, 1138. It can be appreciated that computing objects or devices 1110, 1112, etc. and computing objects or devices 1120, 1122, 1124, 1126, 1128, etc. may comprise different devices, such as PDAs (personal digital assistants), audio/video devices, mobile phones, MP3 players, laptops, etc.

Each computing object or device 1110, 1112, etc. and computing objects or devices 1120, 1122, 1124, 1126, 1128, etc. can communicate with one or more other computing objects or devices 1110, 1112, etc. and computing objects or devices 1120, 1122, 1124, 1126, 1128, etc. by way of the communications network 1140, either directly or indirectly. Even though illustrated as a single element in FIG. 11, network 1140 may comprise other computing objects and computing devices that provide services to the system of FIG. 11, and/or may represent multiple interconnected networks, which are not shown. Each computing object or device 1110, 1112, etc. or 1120, 1122, 1124, 1126, 1128, etc. can also contain an application, such as applications 1130, 1132, 1134, 1136, 1138, that might make use of an API (application programming interface), or other object, software, firmware and/or hardware, suitable for communication with or implementation of various embodiments.

There are a variety of systems, components, and network configurations that support distributed computing environments. For example, computing systems can be connected together by wired or wireless systems, by local networks or widely distributed networks. Currently, many networks are coupled to the Internet, which provides an infrastructure for widely distributed computing and encompasses many different networks, though any network infrastructure can be used for exemplary communications made incident to the techniques as described in various embodiments.

Thus, a host of network topologies and network infrastructures, such as client/server, peer-to-peer, or hybrid architectures, can be utilized. In a client/server architecture, particularly a networked system, a client is usually a computer that accesses shared network resources provided by another computer, e.g., a server. In the illustration of FIG. 11, as a non-limiting example, computing objects or devices 1120, 1122, 1124, 1126, 1128, etc. can be thought of as clients and computing objects or devices 1110, 1112, etc. can be thought of as servers where computing objects or devices 1110, 1112, etc. provide data services, such as receiving data from computing objects or devices 1120, 1122, 1124, 1126, 1128, etc., storing of data, processing of data, transmitting data to computing objects or devices 1120, 1122, 1124, 1126, 1128, etc., although any computer can be considered a client, a server, or both, depending on the circumstances. Any of these computing devices may be processing data, or requesting services or tasks that may implicate various embodiments and related techniques as described herein.

A server is typically a remote computer system accessible over a remote or local network, such as the Internet or wireless network infrastructures. The client process may be active in a first computer system, and the server process may be active in a second computer system, communicating with one another over a communications medium, thus providing distributed functionality and allowing multiple clients to take advantage of the information-gathering capabilities of the server. Any software objects utilized pursuant to the user profiling can be provided standalone, or distributed across multiple computing devices or objects.

In a network environment in which the communications network/bus 1140 is the Internet, for example, the computing objects or devices 1110, 1112, etc. can be Web servers with which the computing objects or devices 1120, 1122, 1124, 1126, 1128, etc. communicate via any of a number of known protocols, such as HTTP. As mentioned, computing objects or devices 1110, 1112, etc. may also serve as computing objects or devices 1120, 1122, 1124, 1126, 1128, etc., or vice versa, as may be characteristic of a distributed computing environment.

Exemplary Computing Device

As mentioned, several of the aforementioned embodiments apply to any device wherein it may be desirable to utilize a computing device according to the aspects disclosed herein. It is understood, therefore, that handheld, portable and other computing devices and computing objects of all kinds are contemplated for use in connection with the various embodiments described herein. Accordingly, the below general purpose remote computer described below in FIG. 12 is but one example, and the embodiments of the subject disclosure may be implemented with any client having network/bus interoperability and interaction.

Although not required, any of the embodiments can partly be implemented via an operating system, for use by a developer of services for a device or object, and/or included within application software that operates in connection with the operable component(s). Software may be described in the general context of computer executable instructions, such as program modules, being executed by one or more computers, such as client workstations, servers or other devices. Those skilled in the art will appreciate that network interactions may be practiced with a variety of computer system configurations and protocols.

Figure 12:
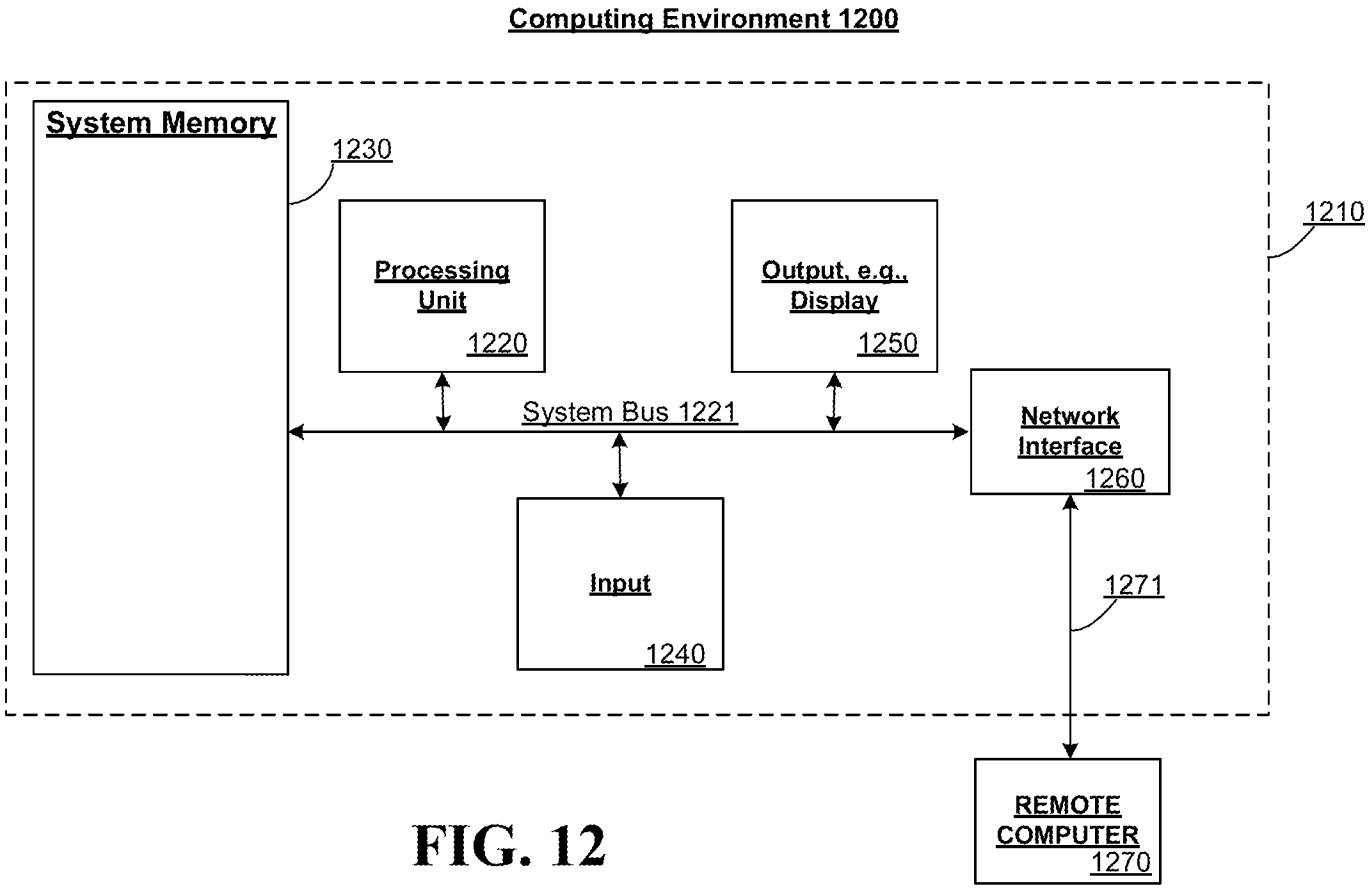
FIG. 12 is a block diagram representing an exemplary non-limiting computing system or operating environment in which one or more aspects of various embodiments described herein can be implemented.

FIG. 12 thus illustrates an example of a suitable computing system environment 1200 in which one or more of the embodiments may be implemented, although as made clear above, the computing system environment 1200 is only one example of a suitable computing environment and is not intended to suggest any limitation as to the scope of use or functionality of any of the embodiments. The computing environment 1200 is not to be interpreted as having any dependency or requirement relating to any one or combination of components illustrated in the exemplary operating environment 1200.

With reference to FIG. 12, an exemplary remote device for implementing one or more embodiments herein can include a general purpose computing device in the form of a handheld computer 1210. Components of handheld computer 1210 may include, but are not limited to, a processing unit 1220, a system memory 1230, and a system bus 1221 that couples various system components including the system memory to the processing unit 1220.

Computer 1210 typically includes a variety of computer readable media and can be any available media that can be accessed by computer 1210. The system memory 1230 may include computer storage media in the form of volatile and/or nonvolatile memory such as read only memory (ROM) and/or random access memory (RAM). By way of example, and not limitation, memory 1230 may also include an operating system, application programs, other program modules, and program data.

A user may enter commands and information into the computer 1210 through input devices 1240 A monitor or other type of display device is also connected to the system bus 1221 via an interface, such as output interface 1250. In addition to a monitor, computers may also include other peripheral output devices such as speakers and a printer, which may be connected through output interface 1250.

The computer 1210 may operate in a networked or distributed environment using logical connections to one or more other remote computers, such as remote computer 1270. The remote computer 1270 may be a personal computer, a server, a router, a network PC, a peer device or other common network node, or any other remote media consumption or transmission device, and may include any or all of the elements described above relative to the computer 1210. The logical connections depicted in FIG. 12 include a network 1271, such local area network (LAN) or a wide area network (WAN), but may also include other networks/buses. Such networking environments are commonplace in homes, offices, enterprise-wide computer networks, intranets and the Internet.

As mentioned above, while exemplary embodiments have been described in connection with various computing devices and networks, the underlying concepts may be applied to any network system and any computing device or system in which it is desirable to publish, build applications for or consume data in connection with the aspects described herein.

The word "exemplary" is used herein to mean serving as an example, instance, or illustration. For the avoidance of doubt, the subject matter disclosed herein is not limited by such examples. In addition, any aspect or design described herein as "exemplary" is not necessarily to be construed as preferred or advantageous over other aspects or designs, nor is it meant to preclude equivalent exemplary structures and techniques known to those of ordinary skill in the art. Furthermore, to the extent that the terms "includes," "has," "contains," and other similar words are used in either the detailed description or the claims, for the avoidance of doubt, such terms are intended to be inclusive in a manner similar to the term "comprising" as an open transition word without precluding any additional or other elements.

As mentioned, the various techniques described herein may be implemented in connection with hardware or software or, where appropriate, with a combination of both. As used herein, the terms "component," "system" and the like are likewise intended to refer to a computer-related entity, either hardware, a combination of hardware and software, software, or software in execution. For example, a component may be, but is not limited to being, a process running on a processor, a processor, an object, an executable, a thread of execution, a program, and/or a computer. By way of illustration, both an application running on computer and the computer can be a component. One or more components may reside within a process and/or thread of execution and a component may be localized on one computer and/or distributed between two or more computers.

The aforementioned systems have been described with respect to interaction between several components. It can be appreciated that such systems and components can include those components or specified sub-components, some of the specified components or sub-components, and/or additional components, and according to various permutations and combinations of the foregoing. Sub-components can also be implemented as components communicatively coupled to other components rather than included within parent components (hierarchical). Additionally, it is noted that one or more components may be combined into a single component providing aggregate functionality or divided into several separate sub-components, and any one or more middle layers, such as a management layer, may be provided to communicatively couple to such sub-components in order to provide integrated functionality. Any components described herein may also interact with one or more other components not specifically described herein but generally known by those of skill in the art.

In view of the exemplary systems described supra, methodologies that may be implemented in accordance with the disclosed subject matter can be appreciated with reference to the various figures. While for purposes of simplicity of explanation, some of the methodologies are shown and described as a series of blocks, it is to be understood and appreciated that the claimed subject matter is not limited by the order of the blocks, as some blocks may occur in different orders and/or concurrently with other blocks from what is depicted and described herein. Where non-sequential, or branched, flow is illustrated via flowchart, it can be appreciated that various other branches, flow paths, and orders of the blocks, may be implemented which achieve the same or a similar result. Moreover, not all illustrated blocks may be required to implement the methodologies described hereinafter.

While in some embodiments, a client side perspective may be inferred, it is to be understood for the avoidance of doubt that a corresponding server perspective exists, or vice versa. Similarly, where a method is practiced, a corresponding device can be provided having storage and at least one processor configured to practice that method via one or more components.

While the various embodiments have been described in connection with the embodiments of the various figures, it is to be understood that other similar embodiments may be used or modifications and additions may be made to the described embodiment for performing the same function without deviating there from. Still further, one or more aspects of the above described embodiments may be implemented in or across a plurality of processing chips or devices, and storage may similarly be affected across a plurality of devices. Therefore, the present invention should not be limited to any single embodiment, but rather should be construed in breadth and scope in accordance with the appended claims.

What is claimed is:

1. A semi-rigid shapeable device, comprising:

a rear region, wherein the rear region is wire-shaped and configured to form a single substantially semi-circle shape having a first end and a second end; and an ends region, wherein the ends region includes:

a first portion extending from the first end to a first terminal end, wherein the first portion is wire-shaped and forms a first bend at the first end, and wherein the first bend is configured to orient the first terminal end upwards and inwards relative to the rear region; and a second portion extending from the second end to a second terminal end, wherein the second portion is wire-shaped and forms a second bend at the second end, and wherein the second bend is configured to orient the second terminal end upwards and inwards relative to the rear region, wherein the rear region and the ends region comprise a single wire-shaped path from the first terminal end to the second terminal end, and wherein the single substantially semi-circle shape of the rear region is configured to provide a single opening directed towards the ends region.

2. The semi-rigid shapeable device according to claim 1, wherein the rear region includes a squared edge opposite to an open region of the substantially semi-circle shape.

3. The semi-rigid shapeable device according to claim 2, further comprising a rear bend at a midpoint of the squared edge, wherein the rear bend is configured to orient the midpoint upwards relative to opposite halves of the squared edge.

4. The semi-rigid shapeable device according to claim 2, wherein the rear region comprises:

a first side portion extending between the squared edge and the first end, wherein the first side portion includes a first intermediate bend at a first intermediate point, and wherein the first intermediate bend is configured to orient the first intermediate point downwards relative to opposite sides of the first side portion; and a second side portion extending between the squared edge and the second end, wherein the second side portion includes a second intermediate bend at a second intermediate point, and wherein the second intermediate bend is configured to orient the second intermediate point downwards relative to opposite sides of the second side portion.

5. The semi-rigid shapeable device according to claim 1, wherein a portion of at least one of the rear region or the ends region further comprises a non-slip coating.

6. The semi-rigid shapeable device according to claim 1, further comprising at least one extension point configured to elongate at least one of the rear region or the ends region.

7. The semi-rigid shapeable device according to claim 1, wherein the first terminal end comprises a first attachment mechanism, and wherein the second terminal end comprises a second attachment mechanism.

8. The semi-rigid shapeable device according to claim 7, wherein each of the first attachment mechanism and the second attachment mechanism are configured to be attachable to one another.

9. The semi-rigid shapeable device according to claim 7, wherein each of the first attachment mechanism and the second attachment mechanism are configured to be attachable to a collar stay.

10. The semi-rigid shapeable device according to claim 7, wherein each of the first attachment mechanism and the second attachment mechanism are at least one of a hook mechanism or a magnetic mechanism.

* * * * *